United States Patent [19]

Nakada et al.

[11] 4,446,595

[45] May 8, 1984

[54] UPRIGHT VACUUM CLEANER

[75] Inventors: Seiichi Nakada, Yokaichi; Hiroshi Ohno, Otu; Tsuneo Nishijima; Hiroshi Kawakami, both of Yokaichi, all of Japan

[73] Assignee: Matsushita Electric Industrial Co., Ltd., Osaka, Japan

[21] Appl. No.: 328,575

[22] PCT Filed: Apr. 30, 1981

[86] PCT No.: PCT/JP81/00069

§ 371 Date: Dec. 2, 1981

§ 102(e) Date: Dec. 2, 1981

[87] PCT Pub. No.: WO81/02830

PCT Pub. Date: Oct. 15, 1981

[30] Foreign Application Priority Data

Apr. 2, 1980 [JP] Japan ..... 55-43945

[51] Int. Cl.[3] ..... A47L 5/34

[52] U.S. Cl. ..... 15/365; 15/373; 15/390

[58] Field of Search ..... 15/328, 365, 373, 390, 15/332; 474/122, 124, 125

[56] References Cited

U.S. PATENT DOCUMENTS

| | | | |
|---|---|---|---|
| 1,435,477 | 11/1922 | Karle | 474/122 |
| 2,682,680 | 6/1954 | Trimble | 15/332 |
| 2,682,681 | 6/1954 | Balluff | 15/332 |
| 4,014,068 | 3/1977 | Payne et al. | 15/373 |

FOREIGN PATENT DOCUMENTS

| | | | |
|---|---|---|---|
| 531804 | 10/1956 | Canada | 15/332 |

*Primary Examiner*—Chris K. Moore

*Attorney, Agent, or Firm*—Lowe, King, Price & Becker

[57] ABSTRACT

An upright vacuum cleaner includes a rotary brush 12 disposed at a suction port in a floor nozzle 4 and capable of being rotated or stopped by shifting a motor-driven belt toward a drive pulley 17 or an idle pulley 18. The upright vacuum cleaner can conveniently be used for cleaning flat noncarpeted floors as well as carpeted floors.

2 Claims, 6 Drawing Figures

UPRIGHT VACUUM CLEANER

FIELD OF THE INVENTION

The present invention relates to an upright vacuum cleaner having a rotatable brush housed in a suction chamber in a floor nozzle.

TECHNOLOGICAL BACKGROUND

Upright vacuum cleaners are designed primarily for cleaning rugs and carpets, and generally include a rotatable brush housed in a suction chamber in a floor nozzle for scraping up and drawing in dust particles from deep inside the pile. Although the upright vacuum cleaners are useful for cleaning the rugs and carpets, they are not suitable for thorough cleaning of uncarpeted floors since the rotatable brush tends to damage the floor as well as cause dust to fly away from the brush on the floor.

Devices are known to eliminate the above problems. One such devices includes a V belt extending under tension between the shaft of a motor and the pulley of a rotatable brush, the pulley having a V-shaped groove variable in width for receiving the V belt. When the width of the V-shaped groove is reduced, the force with which the V belt is pressed against the surface of the groove is increased to the point where rotative power is transmitted from the motor to the rotatable brush. Conversely, when the groove width is increased, the V belt slips in the groove to prevent the brush from rotating. This prior art device requires a complicated mechanism for adjusting the groove width in the pulley, and further requires an intermediate pulley for constantly tensioning the V belt, resulting in an increased cost of the vacuum cleaner. The proposed attempt is particularly disadvantageous in that, when the rotatable brush is at rest, the V belt slips in the pulley groove and becomes much less durable due to heat generated by friction between the V belt and the groove surface.

According to another proposed expedient, the pulley around which a belt is looped is operatively coupled to the rotatable brush through a magnetic clutch. The rotatable brush, however, cannot be completely stopped due to the influence of magnetic flux even when the magnetic clutch is disconnected. To cope with this problem, a special brake mechanism is required to brake the rotary brush, an arrangement which makes the vacuum cleaner disadvantageous from the standpoint of construction and cost of manufacture.

DISCLOSURE OF THE INVENTION

According to the present invention, an idle pulley is mounted adjacent to and in juxtaposed relation to a drive pulley coupled directly to a rotatable brush, and a flat belt is selectively shiftable to one of the pulleys for rotating or stopping the rotatable brush.

An embodiment of the present invention will now be described with reference to the accompanying drawings.

DESCRIPTION OF THE PREFERRED EMBODIMENTS

Figure 1:
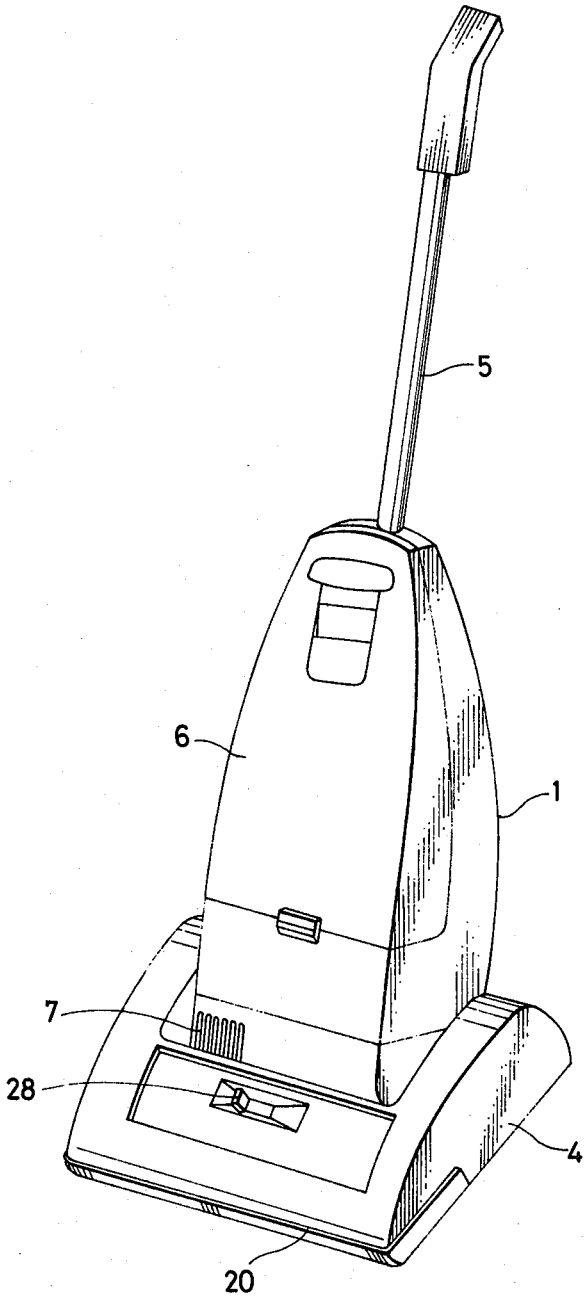
FIG. 1 is a perspective view of an upright vacuum cleaner.

A main body 1 has on a bottom thereof rollers 2 and a suction fan motor 3 in a lower portion thereof. A floor nozzle 4 is pivotably mounted on a lower portion of body 1. A handle 5 projects upwardly from body 1 and a dust collector case 6 is removably attached to a front face of the main body. Dust-laden air is forced to flow through floor nozzle 4 into dust collector case 6. Dust is filtered by a dust collector (filter) disposed at an opening of case 6, and purified air is discharged by fan motor 3 out of a discharge port 7. Dust collected in dust collector case 6 can easily be disposed of by removing the dust collector case from the main body, taking the dust collector off the case, and opening a lower portion of the dust collector.

Floor nozzle 4 comprises upper and lower case members shaped to sandwich the lower portion of main body 1. Nozzle 4 is rotatably mounted on hollow shafts 8 projecting from the sides of the main body.

A shaft 9 of fan motor 3 extends coaxially through one of hollow shafts 8 to project into floor nozzle 4. The floor nozzle 4 has a front suction chamber 10 with its bottom being open to define a suction port 11. A rotatable brush 12 is disposed in suction chamber 10 and has brush bristles projecting a predetermined length from suction port 11. Rotatable brush 12 has a shaft 13 mounted at opposite ends thereof in bearings 14.

Figure 2:
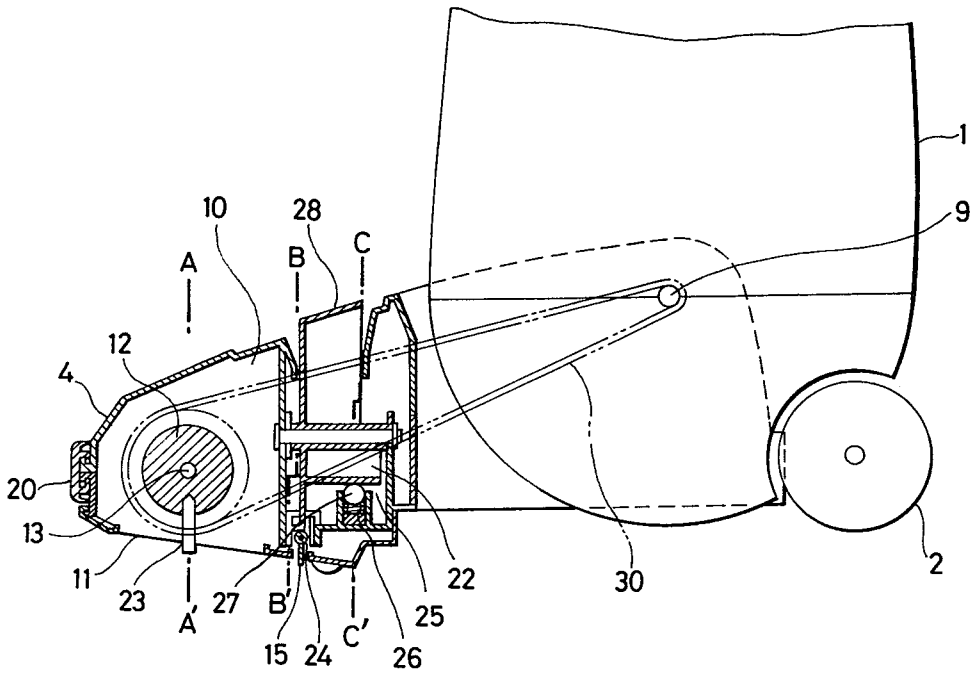
FIG. 2 is a partly cut away side elevational view of the upright vacuum cleaner.
Figure 3:
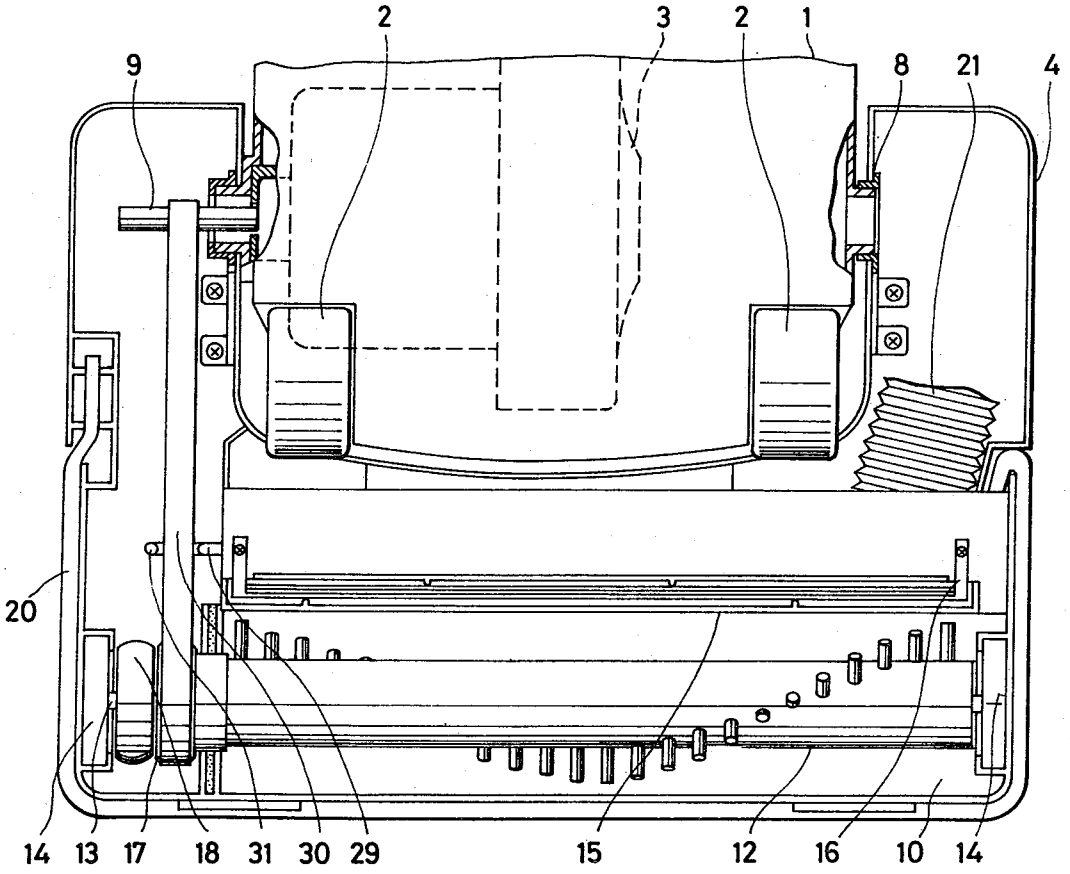
FIG. 3 is a bottom view of the upright vacuum cleaner with a lower case member of a floor nozzle being removed.
Figure 4:
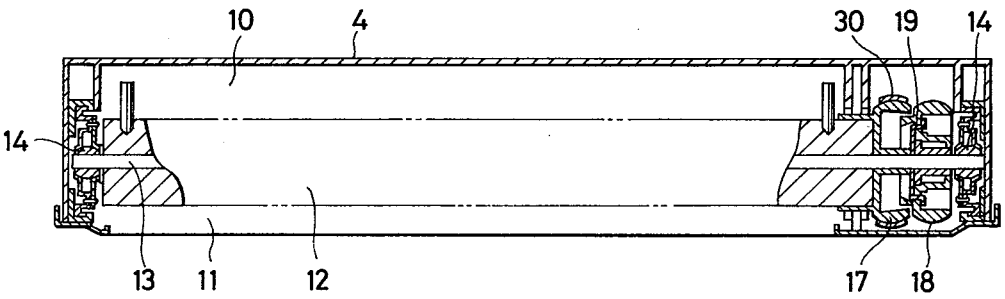
FIG. 4 is a cross-sectional view taken along line A—A' of FIG. 2.
Figure 6:
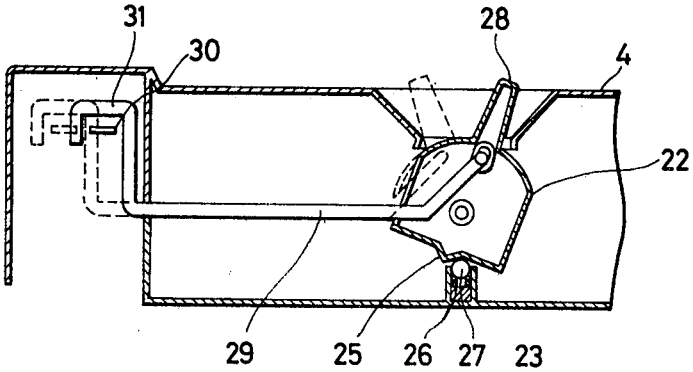
FIG. 6 is a cross-sectional view taken along line C—C' of FIG. 2.

A brush 15, movable into and out of the bottom of the floor nozzle, is provided rearwardly of and extends parallel to rotatable brush 12. When brush 15 projects out of floor nozzle 4, the distal end of the brush is positioned downwardly from the bristles of rotatable brush 12. Brush 15 is urged by a spring 16 in a direction to move into the floor nozzle 4. Drive and idle pulleys 17, 18 made of thermosetting resin are mounted on the shaft 13 of the rotatable brush 12 at a position corresponding to motor shaft 9, the pulleys being disposed adjacent and parallel to each other (see FIG. 3). The drive pulley 17 is coupled to rotatable brush 12, and idle pulley 18 is freely rotatable with respect to shaft 13. A bearing 19 is positioned centrally in idle pulley 18. A bumper 20 supports shaft 13. A hose 21 is connected for communication between suction chamber 10 and main body 1. A brush switching member 22 is pivotally mounted on a shaft 23 (FIG. 2) and includes a cam 24 engageable with an upper edge of brush 15 and a triangular projection 25 on a central lower surface thereof. A ball 27 is urged by a spring 26 against a lower surface of brush switching member 22 having projection 25 (FIG. 6). The brush switching member 22 clicks into position each time ball 27 moves past projection 25. The brush switching member 22 includes an actuation lever 28 projecting upwardly out of floor nozzle 4. A belt switching member 29 is movably supported by a partition of floor nozzle 4, and has a hooked portion 31 on one end which is held in engagement with the flat belt 30 extending under tension between the motor shaft 9 and pulley 17 or 18. The other end of belt switching member 29 is pivotably mounted on brush switching member 22 at a position eccentric with respect to shaft 23 of the brush switching member.

Figure 5:
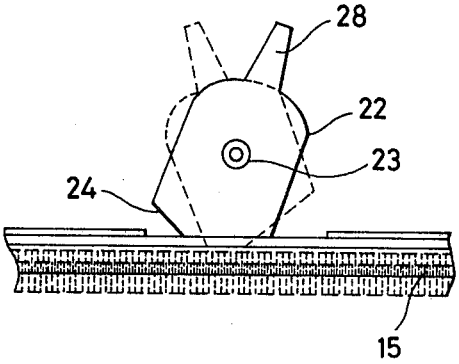
FIG. 5 is a cross-sectional view taken along line B—B' of FIG. 2.

When the vacuum cleaner thus constructed is used to clean a rug or carpet, actuating lever 28 is manipulated to move brush switching member 22 angularly clockwise in FIGS. 5 and 6 into the solid-line position, whereupon cam 24 disengages from brush 15 which retracts under the bias of spring 16 back into floor nozzle 4. Therefore, brush 15 is prevented from being caught by the pile of the carpet or rug, and there is no tendency for the vacuum cleaner to becoming sluggish in motion on the pile. Clockwise angular movement of brush switching member 22 causes the belt switching member 29 to move to the right in FIG. 6, enabling hooked portion 31 to shift flat belt 30 toward drive pulley 17. Therefore, rotative power from fan motor 3 is transmitted via flat belt 30 to drive pulley 17 and hence to the rotatable brush 12.

Dust on the rug or carpet is now scraped by rotatable brush 12 up into suction chamber 10 through suction port 11, and is forced to flow through hose 21 into the dust collector in main body 1.

When a plain floor such as a wooden floor is to be cleaned, the brush switching member 22 is angularly moved in the counterclockwise direction to the dotted-line position.

Cam 24 can push the brush against the resiliency of spring 16 until brush 15 projects downwardly out of floor nozzle 4. The belt switching member 29 is also caused to move to the left in FIG. 6, shifting flat belt 30 toward idle pulley 18. Idle pulley 18, not being connected to shaft 13, can rotate freely, so that rotary brush 12 is held at rest.

While the vacuum cleaner is cleaning the flat floor, the brush 15 serves to collect and guide dust on the floor smoothly into suction port 11, and also acts as an air shield disposed rearwardly of suction port 11 to assist the latter in producing an increased suction force with which to draw dust reliably into the suction chamber. At this time, the floor is protected against being damaged by the rotary brush 12 which is held at rest.

The brush 15 may comprise bristles or an elastic body such as of rubber.

INDUSTRIAL APPLICABILITY

According to the present invention, an upright vacuum cleaner comprises a main body having a fan motor and a dust collector, a floor nozzle housing a rotary brush disposed at a suction port therein a drive pulley coupled to the rotary brush, an idle pulley separated from the drive pulley and disposed parallel and adjacent to the drive pulley, a flat belt for transmitting rotation from the fan motor to one of the pulleys, and a belt switching mechanism for shifting the flat belt to one of the drive and idle pulleys. The upright vacuum cleaner thus arranged can thoroughly clean flat floors as well as rugs and carpets without causing damage thereto. Thus the usable range of the upright vacuum cleaner is extended.

With one of the pulleys being freely rotatable, energy loss is much smaller while the rotary brush is at rest than the prior arrangements using the V belt, with the result that the motor and other parts are subject to a smaller load in operation. The vacuum cleaner of the present invention can be manufactured inexpensively as it requires no intermediate pulley or means for braking the rotary brush.

What is claimed is:

1. An upright vacuum cleaner comprising a main body having a fan motor and a dust collector; a floor nozzle housing a rotary brush disposed at a suction port therein; a drive pulley coupled to said rotary brush, an idle pulley separated from and disposed generally parallel and adjacent said drive pulley; a substantially flat belt for transmitting rotation from said fan motor to one of said pulleys; a belt switching mechanism for shifting said flat belt for selective engagement with the drive pulley or the idle pulley; a brush disposed rearwardly of said suction port; and a brush moving mechanism for moving the brush into and out of the bottom of said floor nozzle;

wherein said belt switching and brush moving mechanisms are operatively connected such that when said flat belt engages the drive pulley, said brush is retracted into said bottom of the floor nozzle, and when said flat belt engages said idle pulley, said brush projects out of said bottom of the floor nozzle to contact a floor.

2. An upright vacuum cleaner according to claim 1, wherein said brush moving mechanism is pivotally mounted on a shaft supported in said floor nozzle and includes a cam engageable with said brush, an actuating lever projecting outwardly from said floor nozzle and connected to selectively move the cam causing the brush to move through the bottom of said floor nozzle, and a projection formed on an outer periphery of the cam against which a ball mounted in the floor nozzle is resiliently pressed to maintain the cam and thereby the the brush in a fixed, switched position.

* * * * *

UNITED STATES PATENT AND TRADEMARK OFFICE

CERTIFICATE OF CORRECTION

PATENT NO. : 4,446,595

DATED : May 8, 1984

INVENTOR(S) : Seiichi NAKADA, Hiroshi OHNO, Tsuneo NISHIJIMA, and Hiroshi KAWAKAMI It is certified that error appears in the above-identified patent and that said Letters Patent is hereby corrected as shown below:

Cover page, Item [22], following "PCT Filed:", change "Apr. 30, 1981" to --March 30, 1981--.

Signed and Sealed this

*Eleventh* Day of *September 1984*

[SEAL]

*Attest:*

GERALD J. MOSSINGHOFF

*Attesting Officer*

*Commissioner of Patents and Trademarks*